US005520872A

United States Patent [19]

Scherer

[11] Patent Number: 5,520,872

[45] Date of Patent: May 28, 1996

[54] METHOD FOR HEMMING EDGES OF STRETCH FILM

[76] Inventor: Philip G. Scherer, 6191 NW. 34th Way, Fort Lauderdale, Fla. 33309

[21] Appl. No.: 103,588

[22] Filed: Aug. 9, 1993

[51] Int. Cl.[6] ..... B29C 53/04

[52] U.S. Cl. ..... 264/285

[58] Field of Search ..... 264/280, 285, 264/339

[56] References Cited

U.S. PATENT DOCUMENTS

| | | | |
|---|---|---|---|
| 3,029,073 | 4/1962 | Wright | 270/86 |
| 3,086,723 | 4/1963 | Meeks | 242/55.2 |
| 3,088,686 | 5/1963 | Curry | 242/55.2 |
| 3,138,512 | 6/1964 | Partin | 156/461 |
| 3,140,059 | 7/1964 | Lusebrink | 242/55.2 |
| 4,166,589 | 9/1979 | Hoover et al. | 242/75.4 |
| 4,477,037 | 10/1984 | Goldstein | 242/75.4 |
| 4,484,717 | 11/1984 | Goldstein | 242/96 |
| 4,845,920 | 7/1989 | Lancaster | 53/399 |
| 4,905,451 | 3/1990 | Jaconelli et al. | 53/410 |

FOREIGN PATENT DOCUMENTS 2109772 6/1983 United Kingdom .

*Primary Examiner*—Leo B. Tentoni

[57] ABSTRACT

A strip of stretch-wrap material having flat, double thickness hems at opposite margins thereof is disclosed. The hemmed strip is formed on apparatus including a first roller having a width less than the width of stock material fed into the machine, whereby opposite margins of the stock material project beyond opposite ends of the roller, and a second roller for guiding the strip at an acute angle from the first roller for causing the opposite marginal portions to fold. The strip is maintained under tension by a take-up roller or other means, and guide bars are provided for further folding the marginal portions past 90° angles so that they continue to be folded inwardly against the main body of the strip.

2 Claims, 1 Drawing Sheet

METHOD FOR HEMMING EDGES OF STRETCH FILM

BACKGROUND OF THE INVENTION

The present invention relates to a stretch film and a method and apparatus for reinforcing edges of such a film.

Thin strips of elastic stretchable plastic material have become widely used for wrapping goods or boxes of goods to be stored or shipped. For example, it is common practice to stack a plurality of boxes on a pallet for shipping and to secure the boxes together, and with respect to the pallet, by wrapping them with a film or strip of resilient plastic material or, in other words, a stretch-wrap. Such stretch-wrapped materials are quite thin and are subject to rupturing or tearing at the edges, particularly in situations where the goods being wrapped have relatively sharp corners or uneven surfaces. Heretofore, it has been suggested to reinforce the edges of such stretch-wrapped materials by gathering or bunching the edges to provide a so-called hem. While such hemming is effective for reinforcing the edges, the bunching may be uneven in appearance and effectiveness and provides ribs or ridges in the ultimate package, which may be objectionable.

SUMMARY OF THE INVENTION

It is an object of the present invention to provide a novel film or strip of stretch-wrap material having a marginal hem which is substantially smooth and flat, as distinguished from a bunching or gathering of material.

A further object of the present invention is to provide a novel method and apparatus for efficiently and economically producing a hemmed, stretch-wrap film of the above-described type.

A still further specific object of the present invention is to provide a novel apparatus for producing a hemmed, stretch-wrap film, which apparatus is of simple and economical construction and may be used with other apparatus which initially produces an unhemmed film, and which also may be used to hem a film pulled from a pre-existing roll of the product.

Other objects and advantages of the present invention will become apparent from the following description and the accompanying drawings described below.

A stretch-wrap film in accordance with the present invention is formed with marginal hems which are flat and unbunched and simply comprise two flat layers of material joined along a fold line. In order to form the hems, an unhemmed strip of film is pulled over a roller having a width less than the width of the strip, so that margins of the strip project beyond ends of the roller. Means is provided for guiding the strip away from the roller at an angle with respect to the plane of the strip approaching the roller for causing the margins to fold through an acute angle over the ends of the roller to initiate forming of the hems. Additional members are positioned adjacent the path of travel of the strip for engaging the partially folded margins for causing the margins to complete the folding action through 180°, and a pressing roller is disposed for ensuring flattening of the strip and the hems.

DESCRIPTION OF AN ILLUSTRATIVE EMBODIMENT

Figure 1:
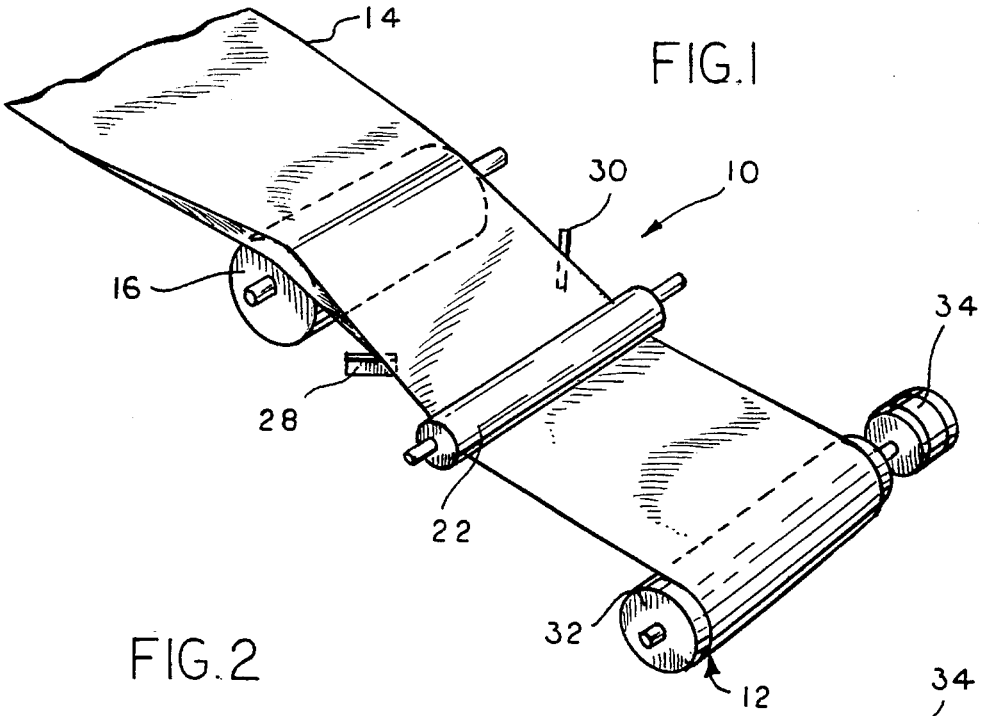
FIG. 1 is a simplified perspective view showing an apparatus for forming a hemmed film or strip in accordance with the method of the present invention.
Figure 2:
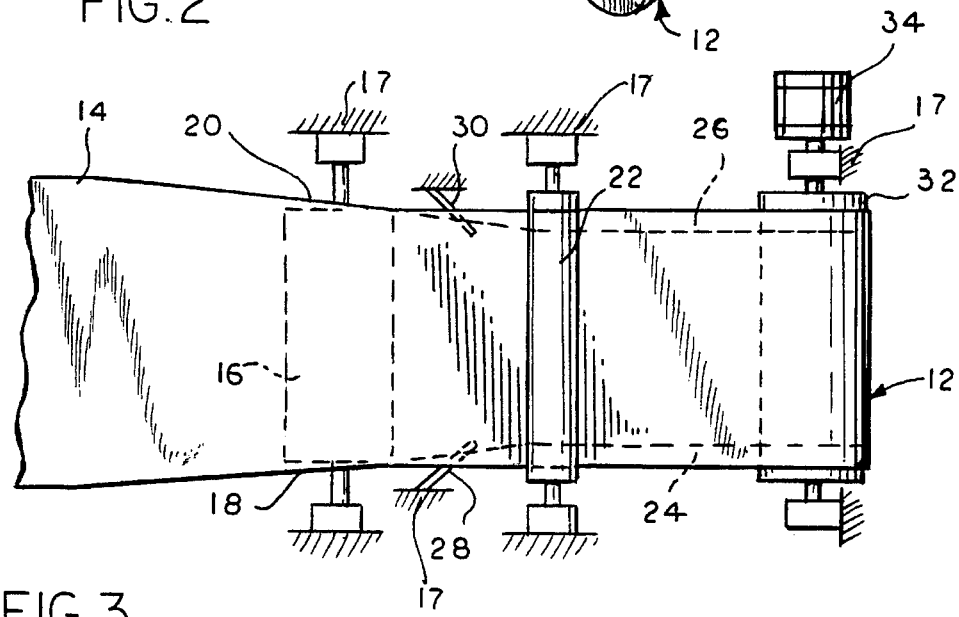
FIG. 2 is a plan view of the apparatus shown in FIG. 1.
Figure 3:
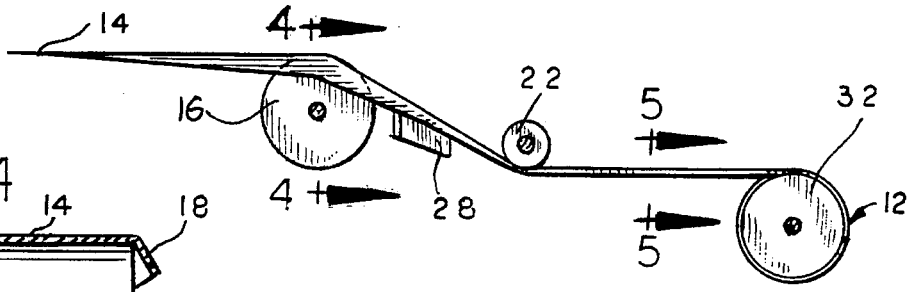
FIG. 3 is a side elevational view of the apparatus shown in FIG. 1.

Referring now more specifically to the drawings, wherein like parts are designated by the same numerals throughout the various figures, an apparatus 10 for forming a hemmed, stretch-wrap film or strip 12 in accordance with the present invention is shown in a simplified and somewhat schematic form in FIGS. 1 through 3. The apparatus is supplied with a strip or film 14 of stock resiliently stretchable plastic stretch-wrap material of any known composition. For example, such films are often composed of polyethylene, polyvinyl chloride, ethylene vinyl acetate, ethylene methyl acetate, and ethylene copolymers with higher alpha olefins. The film or strip 14 of stock material is delivered from a suitable source of supply, not shown, which source may be a film-producing extruding apparatus or the like of known construction, or a roll of previously formed, unhemmed sheet material.

In accordance with the present invention, the flat strip 14 advances to the apparatus 10 along a first path of travel disposed in a first plane and passes over a first guide member or hemming roller 16 rotatably mounted on a suitable frame 17. As shown best in FIGS. 1 and 2, the strip 14 has a predetermined initial width which is greater than the length of the guide member or roller 16. As a result, opposite marginal portions 18 and 20 of the strip 14 project outwardly beyond opposite ends of the roller 16.

Figure 4:
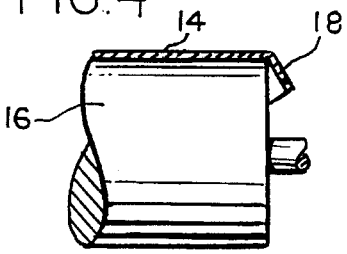
FIG. 4 is an enlarged fragmentary sectional view taken along line 4—4 in FIG. 3.
Figure 5:
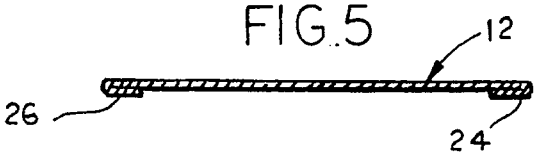
FIG. 5 is an enlarged sectional view taken along line 5—5 in FIG. 3.

A second hemming or pressing member or roller 22 is rotatably mounted on the frame 17 in the apparatus 10 downstream from the roller 16 and at a location for directing the strip 14 passing over the roller 16 downwardly along a path of travel in a plane disposed at an acute angle with respect to the plane of the incoming portion of the strip 14. The strip 14 is maintained under tension, as will be discussed below, and as a result of such tension and the angular relationship between the portions of the strip approaching and leaving the roller 16, the margins 18 and 20 are folded downwardly through acute angles over the opposite ends of the roller 16 to initiate the hemming process, as shown in FIG. 4. It has been found that the optimum deflection angle of the film passing over the roller 16 is about 20°–30°. This arrangement causes the marginal portions 18 and 20 to fold through an acute angle approaching 90°.

In order to complete folding of the marginal portions 18 and 20 to form opposite marginal hems 24 and 26, guide bars or folding members 28 and 30 are mounted on the frame 17 adjacent the path of travel of the film at locations between the rollers 16 and 22. The guide bars are constructed for engaging the partially folded marginal portions 18 and 20 and guiding them beyond a 90° angle. It has been found that once the marginal portions 18 and 20 are folded beyond 90°, they will continue to fold through a full 180° to provide the flat double thickness hems 24 and 26. The pressure applied to the film by the roller 22 ensures that the film and the hems will remain in a substantially flat condition.

In the apparatus shown for illustrating the present invention, a take-up roller 32, driven by a motor 34, is provided.

While the rollers 16 and 22 are idler rollers, the roller 32 is driven at a speed sufficient to maintain the stock material strip 14 and the finally hemmed film or strip 12 under tension for causing the folding of the marginal portions 18 and 20, as discussed above. It is noted however, that the hemmed strip could be maintained under tension in different ways. For example, the guide members or rollers 16 and 22 and the guide bars 28 and 30 could be incorporated into a machine or hand-held unit of known construction, not shown, for applying the stretch-wrap material to products to be wrapped, and the desired tension could be maintained by anchoring an end of the hemmed film 12 to the goods and then pulling the strip through the rollers and guide bars as the strip is wound around the goods.

While a preferred embodiment of the present invention has been shown and described herein, various modifications may be made without departing from the spirit and scope of the appended claims.

The invention is claimed as follows:

1. A method of hemming a strip of a stretch-wrap plastic film comprising maintaining said strip under tension and moving said strip along a first predetermined planar path of travel, engaging a first side of said strip with a first guide member while leaving a marginal portion of the strip unsupported, changing the direction of travel of the strip leaving said guide member to a second path of travel disposed at an acute angle to said first path of travel, and thereby causing said marginal portion to fold at an acute angle with respect to the remainder of said strip, thereafter guiding and further folding said marginal portion beyond a 90° angle with respect to the remainder of said strip while maintaining the strip under tension and thereby causing said marginal portion to be folded through 180° into a flattened condition against the remainder of the strip, and pressing a side of said strip opposite from said one side for promoting the formation of a flat, smooth hem.

2. A method, as defined in claim 1, which includes forming a hem at a margin of said strip opposite from said marginal portion in the same manner as said first-mentioned hem is formed.

* * * * *